US011783755B2

(12) United States Patent
Park et al.

(10) Patent No.: US 11,783,755 B2
(45) Date of Patent: Oct. 10, 2023

(54) DISPLAY DEVICE AND DISPLAY DRIVING METHOD

(71) Applicant: LG DISPLAY CO., LTD., Seoul (KR)

(72) Inventors: SangHyun Park, Seoul (KR); Sieun Park, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/901,711

(22) Filed: Sep. 1, 2022

(65) Prior Publication Data

US 2023/0215335 A1 Jul. 6, 2023

(30) Foreign Application Priority Data

Dec. 30, 2021 (KR) ..... 10-2021-0192651

(51) Int. Cl.

| | |
|---|---|
| ***G09G 3/20*** | (2006.01) |
| ***G09G 3/3233*** | (2016.01) |
| ***G09G 3/3266*** | (2016.01) |
| ***G09G 3/3291*** | (2016.01) |

(52) U.S. Cl.

CPC ..... *G09G 3/2096* (2013.01); *G09G 3/3233* (2013.01); *G09G 3/3266* (2013.01); *G09G 3/3291* (2013.01); *G09G 2300/0819* (2013.01); *G09G 2300/0828* (2013.01); *G09G 2300/0842* (2013.01); *G09G 2310/0294* (2013.01); *G09G 2310/08* (2013.01); *G09G 2320/0233* (2013.01); *G09G 2330/021* (2013.01)

(58) Field of Classification Search

CPC .. G09G 3/2096; G09G 3/3233; G09G 3/3266; G09G 3/3291; G09G 2300/0819; G09G 2300/0828; G09G 2300/0842; G09G 2310/0294; G09G 2310/08; G09G 2320/0233; G09G 2330/021

See application file for complete search history.

(56) References Cited

U.S. PATENT DOCUMENTS

2020/0135072 A1* 4/2020 Min ..... G09G 3/3233
2021/0104195 A1* 4/2021 Choi ..... G09G 3/3233

* cited by examiner

*Primary Examiner* — Amare Mengistu
*Assistant Examiner* — Gloryvid Figueroa-Gibson
(74) *Attorney, Agent, or Firm* — Morgan, Lewis & Bockius LLP

(57) ABSTRACT

The disclosure relates to a disclosed display device and a display driving method. According to an embodiment, the disclosed display device may include a display panel having a first subpixel including a light emitting element and being connected to a sensing line in the display panel for sensing a characteristic value of the first subpixel; a gate driving circuit configured to supply a scan signal to the first subpixel through a gate line in the display panel; a data driving circuit configured to supply a data voltage to the first subpixel through a data line in the display panel; and a timing controller. The timing controller may be configured to: control the gate driving circuit; determine compensation data for compensating for a deviation in the characteristic value of the first subpixel based on a first sensing voltage, a second sensing voltage, and a third sensing voltage on the sensing line; and control the data driving circuit based on the compensation data.

16 Claims, 17 Drawing Sheets

FIG. 14

| Cline | Vsen1 | Vsen2 | Ced1 | Vsen3 | Ced2 | ΔCed |
|---|---|---|---|---|---|---|
| 0.1 | 0.1 | 0.4 | 0.3 | 0.2 | 0.1 | 0.2 |
| 0.1 | 0.1 | 0.5 | 0.4 | 0.2 | 0.1 | 0.3 |
| 0.1 | 0.1 | 0.6 | 0.5 | 0.3 | 0.2 | 0.3 |

DISPLAY DEVICE AND DISPLAY DRIVING METHOD

CROSS-REFERENCE TO RELATED APPLICATION

This application claims priority from Korean Patent Application No. 10-2021-0192651, filed on Dec. 30, 2021, which is hereby incorporated by reference for all purposes as if fully set forth herein.

TECHNICAL FIELD

Embodiments of the present disclosure relate to a display device and a display driving method and, more specifically, a display device and a display driving method capable of effectively sensing and compensating for a subpixel characteristic value.

BACKGROUND

As the information society develops, various demands for display devices for displaying images are increasing. Various types of display devices, such as liquid crystal displays (LCDs) and organic light emitting displays, are used.

Among these display devices, the organic light emitting display adopts organic light emitting diodes and thus has fast responsiveness and various merits in contrast ratio, luminous efficiency, brightness, and viewing angle.

In such a display device, pixels each having subpixels are arrayed in a matrix pattern on the display panel for displaying images. The light emitting element constituting each subpixel is rendered to emit light by controlling the voltage applied to the light emitting element, so that the luminance of each subpixel is controlled, and an image is displayed.

Each subpixel defined on the display panel of the display device has a light emitting element and a driving transistor for driving the light emitting element. The characteristic value of the light emitting element or driving transistor may vary depending on the driving time or a deviation may occur due to a difference in driving time between subpixels. A deviation in luminance between subpixels (luminance non-uniformity) may result, degrading image quality.

To address the deviation in luminance between subpixels, there have been techniques for sensing the characteristic value of the subpixel using a sensing transistor and compensating for the same.

However, these techniques require individually controlling the switching transistor and the sensing transistor of a subpixel to sense the source node voltage of the driving transistor which indicates the characteristic value of the subpixel.

SUMMARY

The inventors of the present disclosure have invented a display device and display driving method capable of effectively sensing and compensating for a deviation in the characteristic value of the subpixel. Accordingly, some embodiments of the present disclosure are directed to a pixel circuit and a display device including the same that substantially obviate one or more problems due to limitations and disadvantages of the related art.

Some embodiments of the present disclosure may provide a display device and display driving method capable of sensing the characteristic value of the subpixel while simultaneously controlling the switching transistor and the sensing transistor.

Embodiments of the present disclosure may provide a display device and display driving method capable of simplifying the circuit configuration of the subpixel and efficiently sensing and compensating for a deviation in the characteristic value of the subpixel by simultaneously controlling the switching transistor and the sensing transistor.

Additional features and aspects will be set forth in part in the description which follows and in part will become apparent from the description or may be learned by practice of the inventive concepts provided herein. Other features and aspects of the inventive concepts may be realized and attained by the structure particularly pointed out in, or derivable from, the written description, the claims hereof, and the appended drawings.

To achieve these and other aspect of the inventive concepts, as embodied and broadly described herein, a display device according to an example embodiment of the present disclosure may comprise: a display panel having a plurality of subpixels for displaying an image, a first subpixel among the plurality of subpixels including a light emitting element and being connected to a sensing line in the display panel for sensing a characteristic value of the first subpixel; a gate driving circuit configured to supply a plurality of scan signals to the display panel, including a scan signal to the first subpixel through a gate line among a plurality of gate lines in the display panel; a data driving circuit configured to supply a plurality of data voltages to the display panel, including a data voltage to the first subpixel through a data line among a plurality of data lines in the display panel; and a timing controller. The timing controller may be configured to: control the gate driving circuit to supply the scan signal to the first subpixel; determine compensation data for compensating for a deviation in the characteristic value of the first subpixel, based on a first sensing voltage corresponding to a line capacitance of the sensing line, a second sensing voltage corresponding to both a first light emitting element capacitance of the light emitting element and the line capacitance of the sensing line, and a third sensing voltage corresponding to both a second light emitting element capacitance of the light emitting element and the line capacitance of the sensing line; and control the data driving circuit based on the compensation data to supply the data voltage to the first subpixel.

In another aspect, for a display device including a display panel having a plurality of subpixels for displaying an image, a first subpixel among the plurality of subpixels including a light emitting element and being connected to a sensing line in the display panel for sensing a characteristic value of the first subpixel, a method of driving the display device may comprise: detecting a first sensing voltage on the sensing line corresponding to a line capacitance formed in a sensing line; detecting a second sensing voltage on the sensing line corresponding to a first light emitting element capacitance of the light emitting element and the line capacitance of the sensing line; detecting a third sensing voltage on the sensing line reflecting a deviation in the characteristic value of the first subpixel; determining the deviation in the characteristic value of the first subpixel based on the first sensing voltage, the second sensing voltage, and the third sensing voltage; determining compensation data according to the deviation in the characteristic value of the first subpixel; and driving the first subpixel based on the compensation data.

According to embodiments of the present disclosure, there may be provided a display device and a display driving method capable of effectively sensing and compensating for a deviation in the characteristic value of the subpixel.

According to embodiments of the present disclosure, there may be provided a display device and a display driving method capable of sensing the characteristic value of the subpixel while simultaneously controlling the switching transistor and the sensing transistor.

According to embodiments of the present disclosure, there may be provided a display device and a display driving method capable of simplifying the circuit configuration of the subpixel and efficiently sensing and compensating for a deviation in the characteristic value of the subpixel by simultaneously controlling the switching transistor and the sensing transistor.

It is to be understood that both the foregoing general description and the following detailed description of the present disclosure are exemplary and explanatory and are intended to provide further explanation of the inventive concepts as claimed.

BRIEF DESCRIPTION OF DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings:

FIG. 14 illustrates an example of data stored in a memory to calculate a deviation in characteristic value between subpixels in a display device according to example embodiments of the present disclosure.

DETAILED DESCRIPTION

Figure 1:
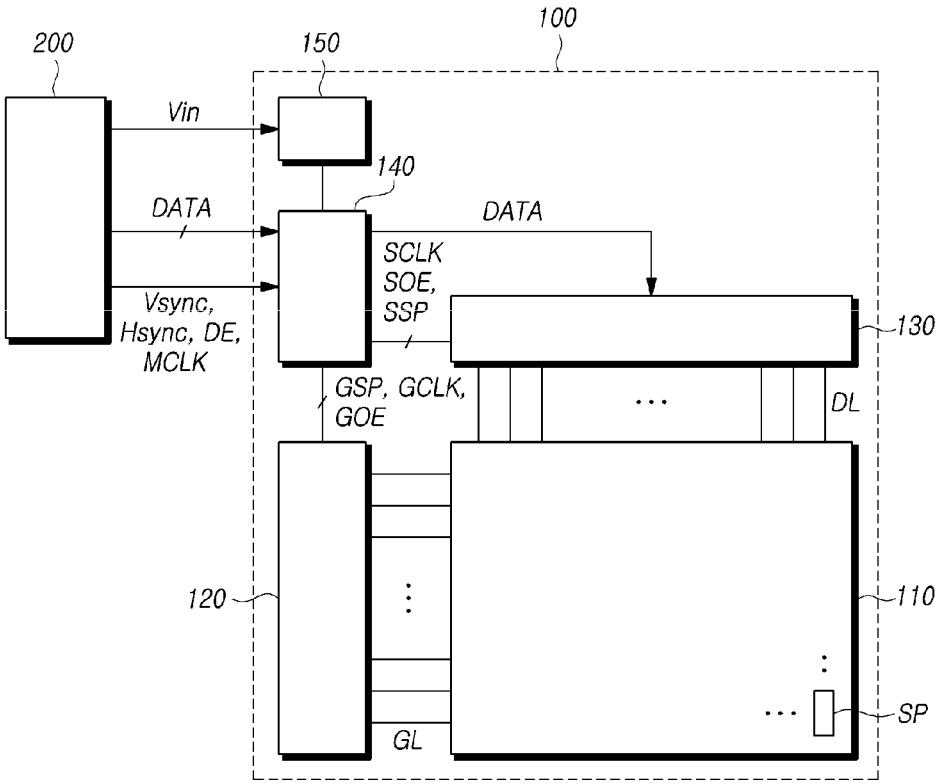
FIG. 1 is a diagram schematically illustrating a configuration of a display device according to various example embodiments of the present disclosure.

In the following description, the progression of processing steps or operations described herein is not limited to the specific example or examples set forth herein and may be changed as is known in the art, unless otherwise specified. Like reference numerals designate like elements throughout, unless otherwise specified. Names of the respective elements used in the following explanations are selected only for convenience of writing the specification and may thus be different from those used in actual products.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the protected scope of the present disclosure is defined by claims and their equivalents.

In the following description, where the detailed description of the relevant known function or configuration may unnecessarily obscure an important point of the present disclosure, a detailed description of such known function of configuration may be omitted.

Where the terms "comprise," "have," "include," "contain," "constitute," "made up of" "formed of," and the like are used, one or more other elements may be added unless a more limiting term, such as "only," is used. An element described in the singular form is intended to include a plurality of elements, and vice versa, unless the context clearly indicates otherwise.

Although the terms "first," "second," A, B, (a), (b), and the like may be used herein to describe various elements, these elements should not be interpreted to be limited by these terms as they are not used to define a particular order or precedence. These terms are used only to distinguish one element from another. For example, a first element could be termed a second element, and, similarly, a second element could be termed a first element, without departing from the scope of the present disclosure.

Where an expression that an element "is connected to," "is coupled to," "is adhered to," "contacts," or "overlaps" another element or layer is used, the element or layer can not only be directly connected, coupled, or adhered to or directly contact or overlap another element or layer, but also be indirectly connected, coupled, or adhered or indirectly contact or overlap another element or layer with one or more intervening elements or layers "disposed," or "interposed" between the elements or layers, unless otherwise specified.

Where a temporal relationship between processes, operations, flows, steps, events, or the like is described as, for example, "after," "subsequent," "next," or "before," the relationship encompasses not only a continuous or sequential order but also a non-continuous or non-sequential relationship unless a more limiting term, such as "just," "immediate(ly)," or "direct(ly)," is used.

The shapes, sizes, ratios, angles, numbers, and the like, which are illustrated in the drawings to describe various example embodiments of the present disclosure, are merely given by way of example. Therefore, the present disclosure is not limited to the illustrations in the drawings.

In construing an element, the element is to be construed as including an ordinary error or tolerance range even where no explicit description of such an error or tolerance range is provided. A tolerance or error range may be caused by various factors, such as process factors, internal or external impact, noise, and the like. Further, the term "may" fully encompasses all the meanings of the term "can."

Reference will now be made in detail to embodiments of the present disclosure, examples of which may be illustrated in the accompanying drawings.

FIG. 1 is a diagram schematically illustrating a configuration of a display device according to various example embodiments of the present disclosure.

As illustrated in FIG. 1, a display device 100 according to an example embodiment of the present disclosure may include a display panel 110 where a plurality of gate lines GL and data lines DL are connected, and a plurality of subpixels SP are arranged in a matrix form. The display device 100 may further include a gate driving circuit 120 for driving the plurality of gate lines GL, a data driving circuit 130 for supplying a data voltage through the plurality of data lines DL, a timing controller 140 for controlling the gate driving circuit 120 and the data driving circuit 130, and a power management circuit 150.

The display panel 110 is configured to display an image based on a scan signal transferred from the gate driving circuit 120 through the plurality of gate line GLs and the data voltage transferred from the data driving circuit 130 through the plurality of data lines DL.

In the case of a liquid crystal display, the display panel 110 may include a liquid crystal layer formed between two substrates and may be operated in any known mode, such as a twisted nematic (TN) mode, a vertical alignment (VA) mode, an in-plane switching (IPS) mode, or a fringe field switching (FFS) mode. In the case of an organic light emitting display, the display panel 110 may be implemented in a top emission scheme, a bottom emission scheme, or a dual-emission scheme.

In the display panel 110, a plurality of pixels may be arranged in a matrix form. Each pixel may include subpixels SP having different colors, e.g., a white subpixel, a red subpixel, a green subpixel, and a blue subpixel. The subpixels SP may be defined respectively by the plurality of data lines DL and the plurality of gate lines GL.

One subpixel SP may include, e.g., a thin film transistor (TFT) formed at the intersection between one data line DL and one gate line GL, a light emitting element, such as an organic light emitting diode, charged with the data voltage, and a storage capacitor electrically connected to the light emitting element to maintain the voltage.

For example, if the display device 100 having a resolution of 2,160×3,840 includes four subpixels SP of white (W), red (R), green (G), and blue (B), 3,840 data lines DL may respectively be connected to 2,160 gate lines GL and four subpixels WRGB. Thus, 3,840×4=15,360 data lines DL may be provided in the display device 100. Each subpixel SP may be disposed at the intersection between the corresponding gate line GL and the corresponding data line DL.

The gate driving circuit 120 may be controlled by the timing controller 140 to sequentially output scan signals to the plurality of gate lines GL disposed in the display panel 110, controlling the driving timing of the plurality of subpixels SP.

In the display device 100 having a resolution of, e.g., 2,160×3,840, sequentially outputting the scan signal to the 2,160 gate lines GL from the first gate line to the 2,160th gate line may be referred to as 2,160-phase driving. Sequentially outputting the scan signal to each unit of four gate lines GL, e.g., sequentially outputting the scan signal to the fifth gate line to the eighth gate line after sequentially outputting the scan signal to the first gate line to the fourth gate line, is referred to as 4-phase driving. In other words, sequentially outputting the scan signal to every N gate lines GL may be referred to as N-phase driving.

The gate driving circuit 120 may include one or more gate driving integrated circuits (GDICs). Depending on the driving schemes implemented, the gate driving circuit 120 may be positioned on only one side, or on each of two opposite sides, of the display panel 110. The gate driving circuit 120 may be implemented in a gate-in-panel (GIP) form and be embedded in the bezel area of the display panel 110.

The data driving circuit 130 may receive image data DATA from the timing controller 140 and convert the received image data DATA into an analog data voltage. Then, as the data voltage may be output to each data line DL according to the timing of the scan signal being applied to the corresponding gate line GL, each subpixel SP connected to the data line DL may display a light emitting signal having the brightness corresponding to the data voltage.

Likewise, the data driving circuit 130 may include one or more source driving integrated circuits SDIC. The source driving integrated circuit SDIC may be connected to the bonding pad of the display panel 110 in a tape automated bonding (TAB) type or a chip-on-glass (COG) type or may be disposed directly on the display panel 110.

In some cases, each source driving integrated circuit SDIC may be integrated and disposed on the display panel 110. Further, each source driving integrated circuit SDIC may be implemented in a chip-on-film (COF) type. In this case, each source driving integrated circuit SDIC may be mounted on a circuit film and may be electrically connected to the corresponding data lines DL of the display panel 110 through the circuit film.

The timing controller 140 may supply various control signals to the gate driving circuit 120 and the data driving circuit 130 and control the operation of the gate driving circuit 120 and the data driving circuit 130. In other words, the timing controller 140 may control the gate driving circuit 120 to output a scan signal according to the timing implemented in each frame and, on the other hand, transfer the image data DATA received from the outside to the data driving circuit 130.

In this case, the timing controller 140 may receive, from an external host system 200, several timing signals including, e.g, a vertical synchronization signal Vsync, a horizontal synchronization signal Hsync, a data enable signal DE, and a main clock MCLK, together with the image data DATA.

The host system 200 may be any one of a television (TV) system, a set-top box, a navigation system, a personal computer (PC), a home theater system, a mobile device, and a wearable device, but the present disclosure is not limited thereto.

Accordingly, the timing controller 140 may generate a control signal according to various timing signals received from the host system 200 and transfer the control signal to the gate driving circuit 120 and the data driving circuit 130.

For example, the timing controller 140 may output several gate control signals including, e.g., a gate start pulse GSP, a gate clock GCLK, and a gate output enable signal GOE, to control the gate driving circuit 120. The gate start pulse GSP may control the timing at which one or more gate driving integrated circuits GDIC constituting the gate driving circuit 120 start operation. The gate clock GCLK is a clock signal commonly input to one or more gate driving integrated circuits GDIC and may control the shift timing of the scan signal. The gate output enable signal GOE may designate timing information about one or more gate driving integrated circuits GDICs.

The timing controller 140 may output various data control signals including, e.g., a source start pulse SSP, a source sampling clock SCLK, and a source output enable signal SOE, to control the data driving circuit 130. The source start pulse SSP may control the timing at which one or more source driving integrated circuits SDIC constituting the data driving circuit 130 start data sampling. The source sampling clock SCLK is a clock signal that may control the timing of sampling data in the source driving integrated circuit(s) SDIC. The source output enable signal SOE may control the output timing of the data driving circuit 130.

The display device 100 may further include a power management circuit 150 that supplies various voltages or currents to, e.g., the display panel 110, the gate driving circuit 120, and the data driving circuit 130 or controls various voltages or currents to be supplied.

The power management circuit 150 may adjust the direct current (DC) input voltage Vin supplied from the host system 200 to generate power required to drive the display panel 100, the gate driving circuit 120, and the data driving circuit 130.

A subpixel SP may be positioned at the intersection between the corresponding gate line GL and the corresponding data line DL, and a light emitting element may be disposed in each subpixel SP. For example, the organic light emitting display may include a light emitting element, such as an organic light emitting diode, in each subpixel SP and may display an image by controlling the current flowing to the light emitting element according to the data voltage.

The display device 100 may be one of various types of devices, such as a liquid crystal display, an organic light emitting display, or a plasma display panel.

Figure 2:
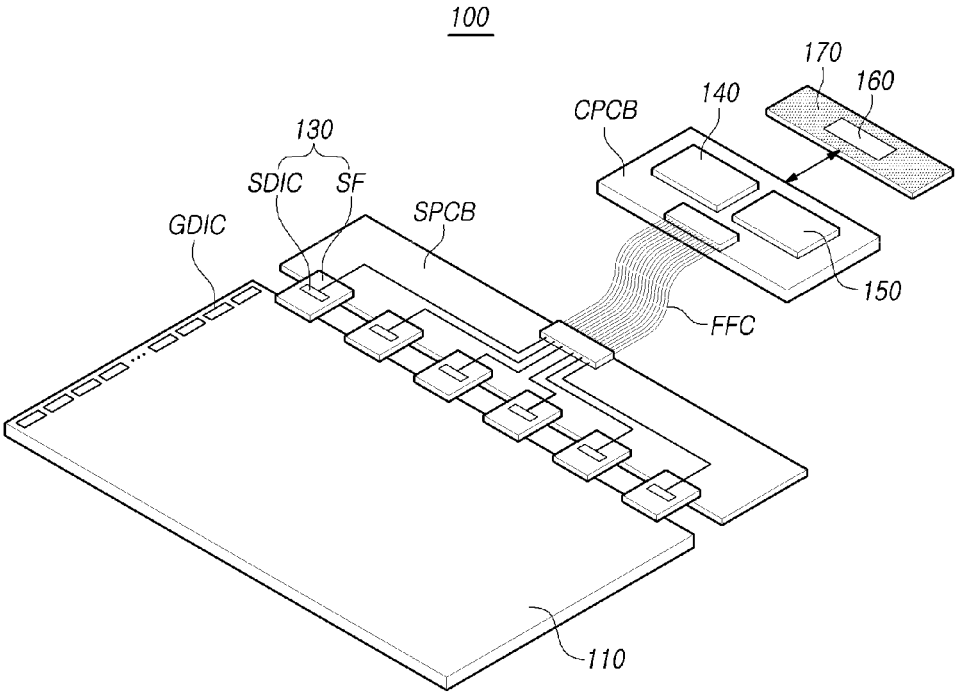
FIG. 2 is a view illustrating an example of a system of a display device according to example embodiments of the present disclosure.

FIG. 2 is a view illustrating an example of a system of a display device according to example embodiments of the present disclosure.

As illustrated in FIG. 2, in the display device 100 according to example embodiments of the present disclosure, the source driving integrated circuits SDIC included in the data driving circuit 130 may be implemented in a chip-on-film (COF) type among various types (e.g., TAB, COG, or COF), and the gate driving circuit 120 may be implemented in a gate-in-panel (GIP) type among various types (e.g., TAB, COG, COF, or GIP).

Where the gate driving circuit 120 is implemented in the GIP type, the plurality of gate driving integrated circuits GDIC included in the gate driving circuit 120 may be directly formed in the bezel area of the display panel 110. In this case, the gate driving integrated circuits GDIC may receive various signals (e.g., a clock signal, a gate high signal, a gate low signal, etc.) for generating scan signals through gate driving-related signal lines disposed in the bezel area.

Likewise, one or more source driving integrated circuits SDIC included in the data driving circuit 130 each may be mounted on a source film SF, and one side of the source film SF may be electrically connected with the display panel 110. Lines for electrically connecting the source driver integrated circuit SDIC and the display panel 110 may be disposed on the source film SF.

The display device 100 may include at least one source printed circuit board SPCB for circuit connection between a plurality of source driving integrated circuits SDIC and other devices and a control printed circuit board CPCB for mounting control components and various electric devices.

The other side of the source film SF where the source driving integrated circuit SDIC is mounted may be connected to at least one source printed circuit board SPCB. In other words, one side of the source film SF where the source driving integrated circuit SDIC is mounted may be electrically connected with the display panel 110, and the other side thereof may be electrically connected with the source printed circuit board SPCB.

The timing controller 140 and the power management circuit 150 may be mounted on the control printed circuit board CPCB. The timing controller 140 may control the operation of the data driving circuit 130 and the gate driving circuit 120. The power management circuit 150 may supply power voltage or current to the display panel 110, the data driving circuit 130, and the gate driving circuit 120 and control the supplied voltage or current.

At least one source printed circuit board SPCB and control printed circuit board CPCB may be circuit-connected through at least one connection member. The connection member may include, e.g., a flexible printed circuit FPC or a flexible flat cable FFC. The at least one source printed circuit board SPCB and control printed circuit board CPCB may be integrated into a single printed circuit board.

The display device 100 may further include a set board 170 electrically connected to the control printed circuit board CPCB. In this case, the set board 170 may also be referred to as a power board. A main power management circuit (M-PMC) 160 for managing the overall power of the display device 100 may be disposed on the set board 170. The main power management circuit 160 may interwork with the power management circuit 150.

In the so-configured example display device 100, the power voltage may be generated in the set board 170 and be transferred to the power management circuit 150 in the control printed circuit board CPCB. The power management circuit 150 may transfer a power voltage for display driving or characteristic value sensing to the source printed circuit board SPCB through the flexible printed circuit FPC or flexible flat cable FFC. The power voltage transferred to the source printed circuit board SPCB may be supplied to emit light or sense a specific subpixel SP in the display panel 110 through the source driving integrated circuit SDIC.

Each of the subpixels SP arranged in the display panel 110 in the display device 100 may include a light emitting element and a circuit element, e.g., a driving transistor, for driving the light emitting element, e.g., an organic light emitting diode.

The type and number of circuit elements constituting each subpixel SP may be varied depending on functions to be provided and design schemes.

Figure 3:
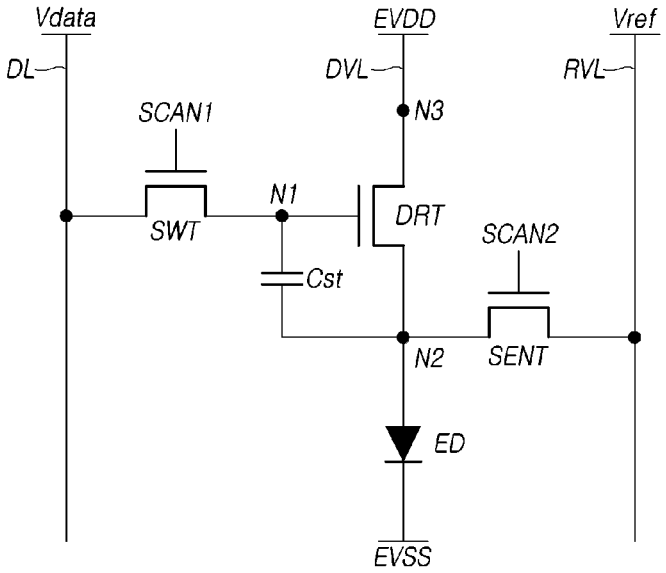
FIG. 3 is a diagram illustrating an example of a subpixel circuit of a display device according to example embodiments of the present disclosure.

FIG. 3 is a diagram illustrating an example of a subpixel circuit of a display device according to example embodiments of the present disclosure.

As illustrated in FIG. 3, in the display device 100 according to example embodiments of the present disclosure, the subpixel circuit may include one or more transistors and a capacitor and may have a light emitting element disposed therein.

For example, the subpixel circuit may include a driving transistor DRT, a switching transistor SWT, a sensing transistor SENT, a storage capacitor Cst, and a light emitting element ED.

The driving transistor DRT may include the first node N1, second node N2, and third node N3. The first node N1 of the driving transistor DRT may be a gate node to which the data voltage Vdata is applied from the data driving circuit 130 through the corresponding data line DL when the switching transistor SWT is turned on.

The second node N2 of the driving transistor DRT may be electrically connected with the anode electrode of the light emitting element ED and may be one of the source node and drain node.

The third node N3 of the driving transistor DRT may be electrically connected with the driving voltage line DVL to which the driving voltage EVDD is applied and may be the other of the drain node and the source node.

In this case, during a display driving period, a driving voltage EVDD for displaying an image may be supplied to the driving voltage line DVL. For example, the driving voltage EVDD for displaying an image may be 27V, but the present disclosure is not limited thereto.

The switching transistor SWT may be electrically connected between the first node N1 of the driving transistor DRT and the data line DL, and a corresponding gate line GL may be connected to the gate node of the switching transistor SWT. Thus, the switching transistor SWT may be operated according to the first scan signal SCAN1 supplied through this gate line GL. When turned on, the switching transistor SWT may transfer the data voltage Vdata supplied through the data line DL to the gate node (i.e., node N1) of the driving transistor DRT, thereby controlling the operation of the driving transistor DRT.

The sensing transistor SENT may be electrically connected between the second node N2 of the driving transistor DRT and the reference voltage line RVL, and a corresponding gate line GL may be connected to the gate node of the sensing transistor SENT. The sensing transistor SENT may be operated according to the second scan signal SCAN2 supplied through this gate line GL. When the sensing transistor SENT is turned on, a reference voltage Vref supplied through the reference voltage line RVL may be transferred to the second node N2 of the driving transistor DRT.

In other words, as the switching transistor SWT and the sensing transistor SENT are controlled, the voltage of the first node N1 and the voltage of the second node N2 of the driving transistor DRT may be controlled, so that the current for driving the light emitting element ED may be supplied.

The gate nodes of the switching transistor SWT and the sensing transistor SENT may be commonly connected to one gate line GL or may be connected to different gate lines GL. An example is shown in which the switching transistor SWT and the sensing transistor SENT are connected to different gate lines GL in which case the switching transistor SWT and the sensing transistor SENT may be independently controlled, respectively, by the first scan signal SCAN1 and the second scan signal SCAN2 transferred through different gate lines GL.

In contrast, if the switching transistor SWT and the sensing transistor SENT are connected commonly to one gate line GL, the switching transistor SWT and the sensing transistor SENT may be simultaneously controlled by the first scan signal SCAN1 or second scan signal SCAN2 transferred through one gate line GL, and the aperture ratio of the subpixel SP may be increased.

Each transistor disposed in the subpixel circuit may be an N-type transistor or a P-type transistor. In the example shown in FIG. 3, the transistors are N-type transistors.

The storage capacitor Cst may be electrically connected between the first node N1 and second node N2 of the driving transistor DRT and maintain the data voltage Vdata during one frame.

The storage capacitor Cst may also be connected between the first node N1 and third node N3 of the driving transistor DRT depending on the type of the driving transistor DRT. The anode electrode of the light emitting element ED may be electrically connected with the second node N2 of the driving transistor DRT, and a base voltage EVSS may be applied to the cathode electrode of the light emitting element ED.

The base voltage EVSS may be a ground voltage or a voltage higher or lower than the ground voltage. The base voltage EVSS may be varied depending on the driving state. For example, the base voltage EVSS at the time of display driving and the base voltage EVSS at the time of sensing driving may be set to differ from each other.

The switching transistor SWT and the sensing transistor SENT may be referred to as scan transistors controlled through scan signals SCAN1 and SCAN2, respectively.

The structure of the subpixel SP may further include one or more additional transistors or, in some cases, further include one or more additional capacitors.

In this case, to effectively sense a characteristic value, e.g., a threshold voltage or mobility, of the driving transistor DRT, the display device 100 may use a method for measuring the current flow by the voltage charged to the storage capacitor Cst during a characteristic value sensing period of the driving transistor DRT. This is referred to as current sensing.

In other words, it is possible to figure out the characteristic value, or a variation in characteristic value, of the driving transistor DRT in the subpixel SP by measuring the current flow by the voltage charged to the storage capacitor Cst during the characteristic value sensing period of the driving transistor DRT.

In this case, the reference voltage line RVL may serve not only to transfer the reference voltage Vref but also as a sensing line for sensing the characteristic value of the driving transistor DRT in the subpixel. Thus, the reference voltage line RVL may also be referred to as a sensing line or a sensing channel.

More specifically, the characteristic value or a change in the characteristic value of the driving transistor DRT may correspond to a difference between the gate node voltage and the source node voltage of the driving transistor DRT.

The compensation for the characteristic value of the driving transistor DRT may be performed by external compensation that senses and compensates for the characteristic value of the driving transistor DRT using an external compensation circuit. Alternatively, the compensation may be performed by internal compensation that senses and compensates for the characteristic value of the driving transistor DRT inside the subpixel SP, rather than using an additional external configuration.

In this case, the external compensation may be performed before the display device 100 is shipped out, and the internal compensation may be performed after the display device 100 is shipped out. However, internal compensation and external compensation may be performed together even after the display device 100 is shipped out.

Figure 4:
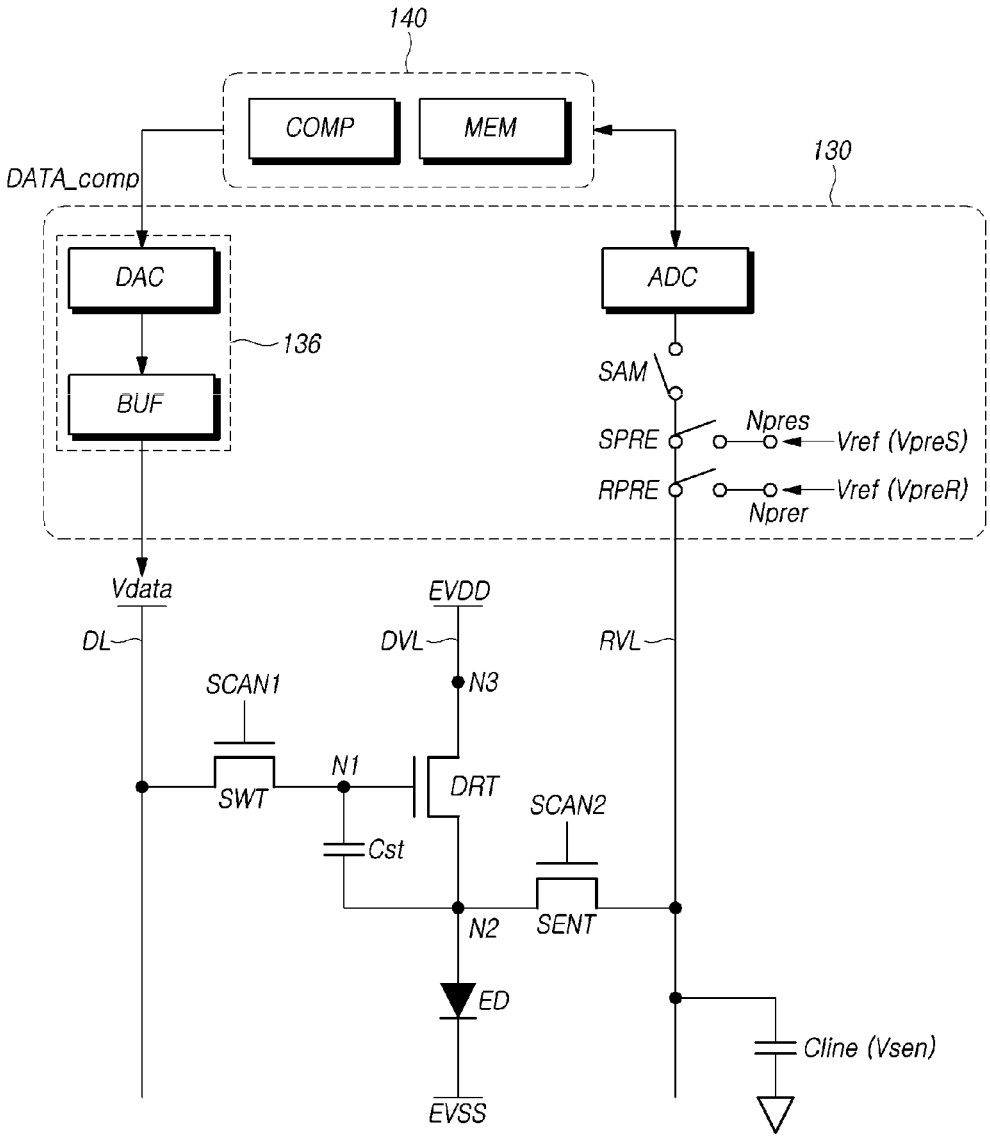
FIG. 4 is a diagram illustrating an example circuit structure for sensing a characteristic value of a subpixel in a display device according to example embodiments of the present disclosure.

FIG. 4 is a diagram illustrating an example circuit structure of sensing a characteristic value of a subpixel in a display device according to example embodiments of the present disclosure.

As illustrated in FIG. 4, a display device 100 according to example embodiments of the present disclosure may include components for compensating for a deviation in the characteristic value between subpixels SP.

For example, in the sensing period of the display device 100, the characteristic value or a change in the characteristic value of the subpixel SP may be applied as the voltage (e.g., Vdata−Vth) of the second node N2 corresponding to the source node of the driving transistor DRT.

The voltage of the second node N2 of the driving transistor DRT may correspond to the voltage of the reference voltage line RVL when the sensing transistor SENT is in the turned-on state. The line capacitor Cline on the reference voltage line RVL may be charged by the voltage of the second node N2 of the driving transistor DRT. The reference voltage line RVL may have a voltage corresponding to the voltage of the second node N2 of the driving transistor DRT due to the sensing voltage Vsen charged to the line capacitor Cline.

The display device 100 may include an analog-to-digital converter ADC that may measure the voltage of the reference voltage line RVL corresponding to the voltage of the second node N2 of the driving transistor DRT and convert the voltage into a digital value. The display device 100 may also include a switch circuit for sensing the characteristic value.

The switch circuit for controlling the sensing driving may include a sensing reference switch SPRE for controlling the connection between each reference voltage line RVL and the sensing reference voltage supply node Npres to which the reference voltage Vref is supplied. The switch circuit may also include a sampling switch SAM for controlling the connection between each reference voltage line RVL and the analog-to-digital converter ADC. The sensing reference switch SPRE may be a switch for controlling sensing driving, and the reference voltage Vref supplied to the reference voltage line RVL by the sensing reference switch SPRE may become the sensing reference voltage VpreS. The sensing reference voltage VpreS may be a ground voltage.

The switch circuit for sensing the characteristic value of the subpixel SP may include a display reference switch RPRE for controlling display driving. The display reference switch RPRE may control the connection between each reference voltage line RVL and the display reference voltage supply node Nprer to which the reference voltage Vref is supplied. The display reference switch RPRE may be a switch used to drive the display, and the reference voltage Vref supplied to the reference voltage line RVL by the display reference switch RPRE may correspond to the display reference voltage VpreR.

In this case, the sensing reference switch SPRE and the display reference switch RPRE may be separately provided or may be integrated into one. The sensing reference voltage VpreS and the display reference voltage VpreR may have the same voltage value or different voltage values.

The timing controller 140 of the display device 100 may include a memory MEM for storing the data transferred from the analog-to-digital converter ADC or for previously storing a reference value. The timing controller 140 may also include a compensation circuit COMP configured to compare the reference value stored in the memory MEM and the received data and to compensate for the deviation in characteristic value. In this case, the compensation value calculated by the compensation circuit COMP may be stored in the memory MEM.

Accordingly, the timing controller 140 may compensate for the image data DATA to be supplied to the data driving circuit 130 by using the compensation value calculated by the compensation circuit COMP and may output the compensated image data DATA_comp to the data driving circuit 130. Accordingly, the data driving circuit 130 may convert the compensated image data DATA_comp into an analog signal type of data voltage Vdata through a digital-to-analog converter DAC and output the converted data voltage Vdata to the data line DL through an output buffer BUF. As a result, the deviation in characteristic value (e.g., deviation in threshold voltage deviation or deviation in mobility) for the driving transistor DRT in the corresponding subpixel SP may be compensated for.

As described above, the period for sensing the characteristic value of the subpixel SP may be after the power-on signal is generated and before display driving starts. For example, if a power-on signal is applied to the display device 100, the timing controller 140 may load parameters for driving the display panel 110 and then drive the display. In this case, the parameters for driving the display panel 110 may include information about the sensing and compensation for characteristic values previously performed on the display panel 110. In the parameter loading process, the sensing of characteristic values of the subpixel SP may be performed. As described above, a process in which the characteristic value is sensed in the parameter loading process after the power-on signal is generated and before the subpixel emits light may be referred to as an on-sensing process.

Alternatively, a period in which the characteristic value of the subpixel SP is sensed may be after a power-off signal of the display device 100 is generated. For example, when a power-off signal is generated in the display device 100, the timing controller 140 may cut off the data voltage supplied to the display panel 110 and may sense the driving characteristic value of the subpixel SP for a predetermined time. As such, a process in which sensing of the characteristic value is performed in a state in which the data voltage is cut off as a power-off signal is generated so that emission of the subpixel is terminated may be referred to as an off-sensing process.

The sensing process for the characteristic value of the subpixel SP may be performed in real time while the display is driven. This sensing process may be referred to as a real-time (RT) sensing process. In the real-time sensing process, the sensing process may be performed on one or more subpixels SP in one or more lines of subpixel SP, in each blank period during the display driving period.

In other words, during the display driving period when an image is displayed on the display panel 110, a blank period in which the data voltage is not supplied to the subpixel SP exists within one frame or between one frame and the next frame. In the blank period, mobility sensing for one or more subpixels SP may be performed.

As such, when the sensing process is performed in the blank period, the line of subpixels SP on which the sensing process is performed may be randomly selected. Accordingly, after the sensing process in the blank period is performed, an abnormality that may appear in the display driving period may be alleviated. After the sensing process is performed during the blank period, the compensated data voltage may be supplied to the subpixels SP where the sensing process has been performed during the display driving period. Accordingly, in the display driving period after the sensing process in the blank period, abnormalities in the line of subpixels SP where the sensing process has been completed may be further alleviated.

The data driving circuit 130 may include a data voltage output circuit 136 including a latch circuit (not illustrated), a digital-to-analog converter DAC, and an output buffer BUF. In some cases, the data driving circuit 130 may further include an analog-to-digital converter ADC and various switches SAM, SPRE, and RPRE. Alternatively, the analog-to-digital converter ADC and various switches SAM, SPRE, and RPRE may be positioned outside the data driving circuit 130.

The compensation circuit COMP may be present inside or outside the timing controller 140. The memory MEM may be positioned outside the timing controller 140 or may be implemented, e.g., in the form of a register, inside the timing controller 140.

Figure 5:
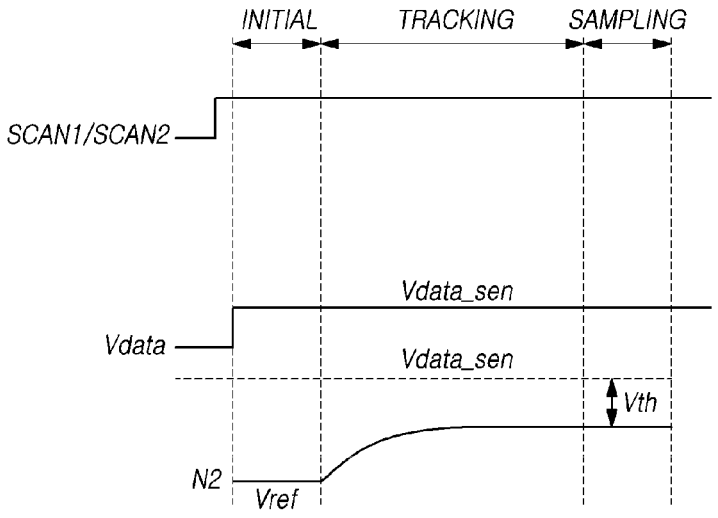
FIG. 5 is a signal timing diagram illustrating an example of external compensation for a threshold voltage of a driving transistor.

FIG. 5 is a signal timing diagram illustrating an example of external compensation for a threshold voltage of a driving transistor.

As shown in FIG. 5, the sensing of the threshold voltage Vth of the driving transistor DRT in the example display device 100 may be performed in an initialization phase INITIAL, a tracking phase TRACKING, and a sampling phase SAMPLING.

In this case, since the switching transistor SWT and the sensing transistor SENT are simultaneously turned on and turned off for sensing the threshold voltage Vth of the driving transistor DRT, the first scan signal SCAN1 and the second scan signal SCAN2 together may be applied through one gate line GL, or the first scan signal SCAN1 and the second scan signal SCAN2 may be applied at the same time through different gate lines GL.

The initialization phase INITIAL is a period in which the second node N2 of the driving transistor DRT may be charged with the reference voltage Vref for sensing the threshold voltage Vth of the driving transistor DRT, and the first scan signal SCAN1 and the second scan signal SCAN2 which have high levels may be applied through the gate line GL.

The tracking phase TRACKING is a period in which charges may be stored in the storage capacitor Cst after the charging of the second node N2 of the driving transistor DRT is completed.

The sampling phase SAMPLING is a period in which a current flow from the charge stored in the storage capacitor Cst is detected after the storage capacitor Cst of the driving transistor DRT is charged.

If the first scan signal SCAN1 and the second scan signal SCAN2 at the turn-on level are simultaneously applied in the initialization phase INITIAL, the switching transistor SWT may be turned on. Accordingly, the first node N1 of the driving transistor DRT may be initialized to the sensing data voltage Vdata_sen for sensing the threshold voltage Vth.

The sensing transistor SENT may also be turned on by the first scan signal SCAN1 and the second scan signal SCAN2 at the turn-on level, and the reference voltage Vref may be applied through the reference voltage line RVL. Thus, the second node N2 of the driving transistor DRT may be initialized to the reference voltage Vref.

In the tracking phase TRACKING, the voltage of the second node N2 of the driving transistor DRT reflecting the threshold voltage Vth of the driving transistor DRT may be tracked. To this end, in the tracking phase TRACKING, the switching transistor SWT and the sensing transistor SENT may remain in the turned-on state, and the reference voltage Vref applied through the reference voltage line RVL may be cut off.

Accordingly, the second node N2 of the driving transistor DRT may float, and the voltage at the second node N2 of the driving transistor DRT may start to rise from the reference voltage Vref. In this case, since the sensing transistor SENT is on, the increase in the voltage at the second node N2 of the driving transistor DRT may lead to an increase in the voltage on the reference voltage line RVL.

In this process, the voltage at the second node N2 of the driving transistor DRT may be increased and then saturated. The saturation voltage at the time when the second node N2 of the driving transistor DRT reaches the saturated state may correspond to the difference (Vdata_sen−Vth) between the sensing data voltage Vdata_sen for sensing the threshold voltage Vth and the threshold voltage Vth of the driving transistor DRT.

In the sampling phase SAMPLING, the high-level first scan signal SCAN1 and second scan signal SCAN2 to the gate line GL may be maintained, and the charge stored in the storage capacitor Cst of the driving transistor DRT may be sensed by the characteristic value sensing circuit included in the data driving circuit 130.

Figure 6:
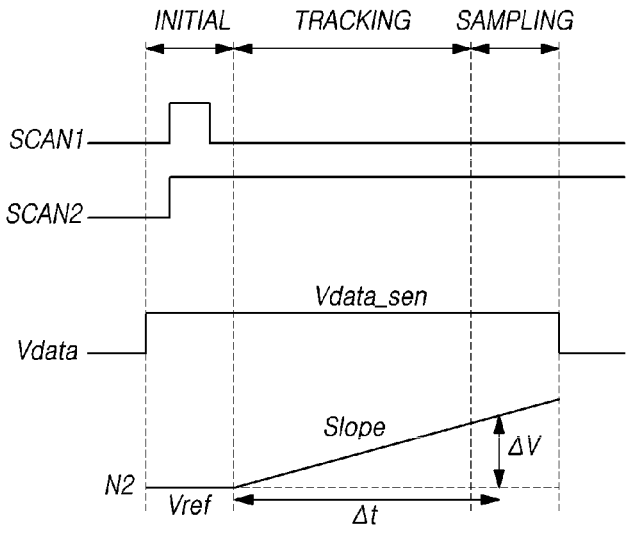
FIG. 6 is a signal timing diagram illustrating an example of external compensation for a mobility of a driving transistor.

FIG. 6 is a signal timing diagram illustrating an example of external compensation for a mobility of a driving transistor.

As shown in FIG. 6, like the sensing of the threshold voltage Vth, the sensing of the mobility of the driving transistor DRT in the example display device 100 may be performed in an initialization phase INITIAL, a tracking phase TRACKING, and a sampling phase SAMPLING.

In the initialization phase INITIAL, the switching transistor SWT may be turned on by the first scan signal SCAN1 at the turn-on level, so that the first node N1 of the driving transistor DRT may be initialized to the sensing data voltage Vdata_sen for mobility sensing. Further, the sensing transistor SENT may be turned on by the second scan signal SCAN2 at the turn-on level and, in this state, the second node N2 of the driving transistor DRT may be initialized to the reference voltage Vref.

The tracking phase TRACKING is a phase for tracking the mobility of the driving transistor DRT. The mobility of the driving transistor DRT may indicate the current driving capability of the driving transistor DRT, and the mobility of the driving transistor DRT may be calculated by tracking the voltage at the second node N2 of the driving transistor DRT through the tracking phase TRACKING.

In the tracking phase TRACKING, the switching transistor SWT may be turned off by the first scan signal SCAN1 at the turn-off level, and the switch through which the reference voltage Vref is applied to the reference voltage line RVL may be cut off. Accordingly, both the first node N1 and the second node N2 of the driving transistor DRT may float, and the voltages at the first node N1 and the second node N2 of the driving transistor DRT may both increase.

In particular, since the voltage at the second node N2 of the driving transistor DRT may be initialized to the reference voltage Vref, it may start to increase from the reference voltage Vref. In this case, since the sensing transistor SENT is on, the increase in the voltage at the second node N2 of the driving transistor DRT may lead to an increase in the voltage on the reference voltage line RVL.

In the sampling phase SAMPLING, the characteristic value sensing circuit may detect the voltage at the second node N2 of the driving transistor DRT, a predetermined amount of time Δt after the voltage at the second node N2 starts to increase.

In this case, the sensing voltage detected by the characteristic value sensing circuit may indicate a voltage Vref+ΔV, which is the reference voltage Vref plus a predetermined voltage ΔV. The mobility of the driving transistor DRT may be calculated based on the so-detected sensing voltage Vref+ΔV, the reference voltage Vref which is already known, and the amount of time Δt for the voltage at the second node N2 to increase by ΔV.

In other words, the mobility of the driving transistor DRT is proportional to the voltage variation ΔV/Δt per unit time of the reference voltage line RVL through the tracking phase TRACKING and the sampling phase SAMPLING. Accordingly, the mobility of the driving transistor DRT may be proportional to the slope of the voltage waveform on the reference voltage line RVL.

However, in this example, the switching transistor and the sensing transistor are individually controlled via the first scan signal SCAN1 and the second signal SCAN2, respectively, to sense the source node (N2) voltage of the driving transistor DRT, and therefore to sense the mobility of the driving transistor DRT.

The display device 100 according to example embodiments of the present disclosure may simultaneously control the switching transistor SWT and the sensing transistor SENT constituting the subpixel SP by way of one scan signal SCAN, thereby simplifying the circuit configuration of the subpixel SP while effectively sensing and compensating for the source node voltage of the driving transistor DRT corresponding to the characteristic value of the subpixel SP.

To this end, it may be possible to control the first scan signal SCAN1 applied to the gate node of the switching transistor SWT constituting the subpixel SP and the second scan signal SCAN2 applied to the gate node of the sensing transistor SENT according to the same driving timing or to electrically connect the gate node of the switching transistor SWT and the gate node of the sensing transistor SENT to apply one scan signal SCAN to them.

Thus, described below is an example of applying a single scan signal SCAN to the gate node of the switching transistor SWT and to the gate node of the sensing transistor SENT.

However, it should be noted that example embodiments of the present disclosure may include not only an example display device 100 configured to apply a single scan signal SCAN to the gate node of the switching transistor SWT and to the gate node of the sensing transistor SENT, but also an example display device configured to control the first scan signal SCAN1 applied to the gate node of the switching transistor SWT and the second scan signal SCAN2 applied to the gate node of the sensing transistor SENT according to the same driving timing.

Further, in some operational process of the example display device 100 of the present disclosure, the same effect may also be achieved despite independently controlling each of the first scan signal SCAN1 applied to the gate node of the switching transistor SWT and the second scan signal SCAN2 applied to the gate node of the sensing transistor SENT.

Figure 7:
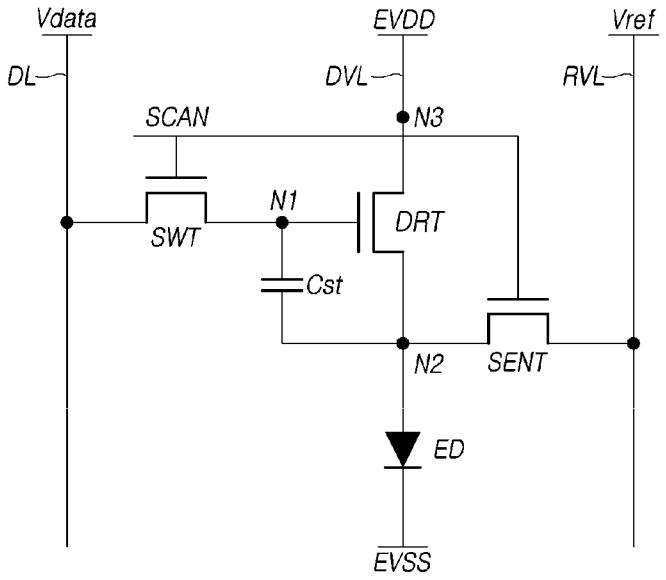
FIG. 7 is a diagram illustrating another example of a subpixel circuit in a display device according to example embodiments of the present disclosure.

FIG. 7 is a diagram illustrating another example of a subpixel circuit in a display device according to example embodiments of the present disclosure.

As illustrated in FIG. 7, in the display device 100 according to example embodiments of the present disclosure, the subpixel circuit may include one or more transistors and a capacitor and may have a light emitting element disposed therein.

For example, the subpixel circuit may include a driving transistor DRT, a switching transistor SWT, a sensing transistor SENT, a storage capacitor Cst, and a light emitting element ED.

The configuration of the driving transistor DRT, the switching transistor SWT, the sensing transistor SENT, the storage capacitor Cst, and the light emitting element ED is substantially the same as that shown FIG. 3.

However, the configuration of FIG. 7 differs from the configuration of FIG. 3 in relation to the respective gate nodes of the switching transistor SWT and the sensing transistor SENT. In the configuration of FIG. 3, the first scan signal SCAN1 is applied to the gate node of the switching transistor SWT, and the second scan signal SCAN2 is applied to the gate node of the sensing transistor SENT. In contrast, in the configuration of FIG. 7, the gate node of the switching transistor SWT and the gate node of the sensing transistor SENT may be electrically connected with each other, and the switching transistor SWT and the sensing transistor SENT may be simultaneously controlled by one scan signal SCAN applied to their respective gate nodes.

Accordingly, it is possible to simultaneously control the switching transistor SWT and the sensing transistor SENT by controlling the first scan signal SCAN1 applied to the gate node of the switching transistor SWT and the second scan signal SCAN2 applied to the gate node of the sensing transistor SENT according to the same timing in the configuration of FIG. 3. However, in the configuration of FIG. 7, it is possible to simultaneously control the switching transistor SWT and the sensing transistor SENT by applying one scan signal SCAN to the gate nodes of both transistors SWT and SENT.

Described below is an example of simultaneously controlling the switching transistor SWT and the sensing transistor SENT by applying one scan signal SCAN.

Figure 8:
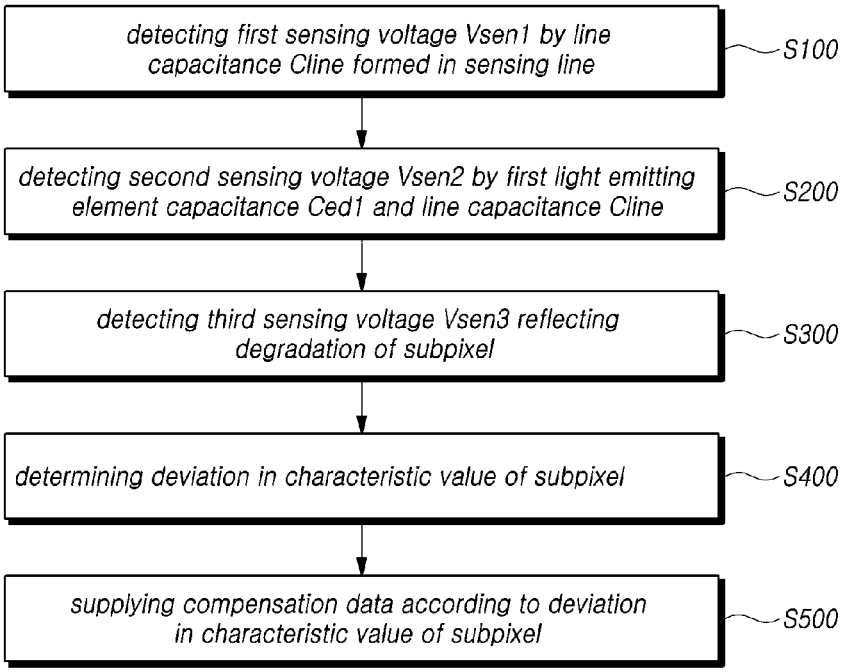
FIG. 8 is a flowchart illustrating a display driving method according to example embodiments of the present disclosure.

FIG. 8 is a flowchart illustrating a display driving method according to example embodiments of the present disclosure.

As shown in FIG. 8, a display driving method according to example embodiments of the present disclosure may include step S100 of detecting a first sensing voltage Vsen1 by a line capacitance Cline formed in a sensing line, step S200 of detecting a second sensing voltage Vsen2 by a first light emitting element capacitance Ced1 and the line capacitance Cline, step S300 of detecting a third sensing voltage Vsen3 reflecting degradation of the subpixel SP, step S400 of determining a deviation in the characteristic value of the subpixel SP, and step S500 of supplying compensation data according to the deviation in the characteristic value of the subpixel SP.

The step S100 of detecting the first sensing voltage Vsen1 by the line capacitance Cline formed in the sensing line may be a process for detecting the line capacitance Cline formed in the sensing line for sensing the characteristic value of the subpixel SP. The sensing line may be the reference voltage line RVL to which the reference voltage Vref is applied.

Figure 9A:
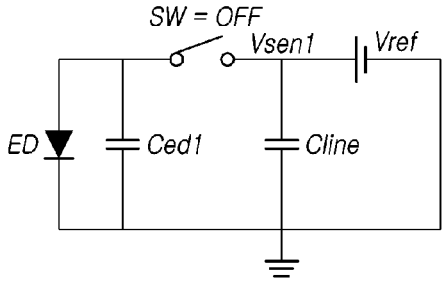
FIGS. 9A and 9B illustrate an example process for detecting a first sensing voltage by a line capacitance formed in a sensing line in a display driving method according to example embodiments of the present disclosure.
Figure 9B:
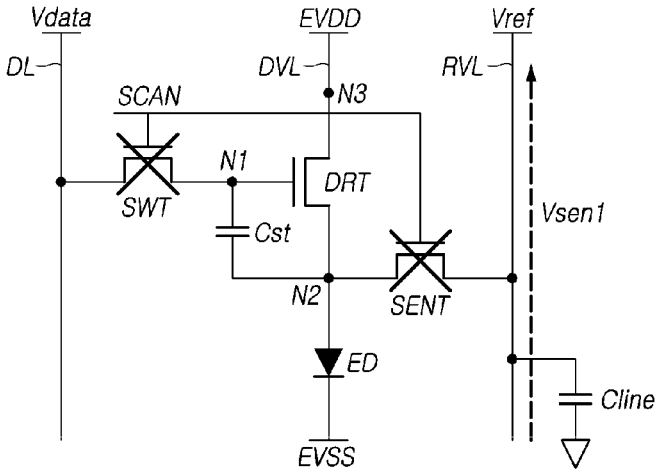

FIGS. 9A and 9B illustrate an example process for detecting a first sensing voltage by a line capacitance formed in a sensing line in a display driving method according to example embodiments of the present disclosure.

As illustrated in FIGS. 9A and 9B, the display driving method according to example embodiments of the present disclosure may detect the line capacitance Cline formed in the sensing line RVL before degradation of the subpixel SP disposed in the display panel 110 occurs. In other words, the step S100 of detecting the first sensing voltage Vsen1 by the line capacitance Cline formed in the sensing line may preferably be performed before the display device 100 is shipped out.

To this end, in a state in which the connection between the light emitting element ED of the subpixel SP and the sensing line RVL is cut off, the reference voltage Vref may be applied to the sensing line RVL. After the sensing line RVL is discharged for a predetermined time, the sensing voltage Vsen1 may be measured, so that the line capacitance Cline formed in the sensing line may be detected.

Conceptually (as shown in FIG. 9A), the switch SW positioned between the light emitting element ED and the sensing line may be turned off to electrically insulate the light emitting element ED from the sensing line. As a result, the initial first light emitting element capacitance Ced1 formed between the anode electrode and the cathode electrode of the light emitting element ED may not affect the sensing line RVL.

If this concept is applied to the subpixel circuit (as shown in FIG. 9B), the switch SW connecting the light emitting element ED and the sensing line RVL may correspond to the sensing transistor SENT.

Accordingly, the step S100 of detecting the first sensing voltage Vsen1 by the line capacitance Cline formed in the sensing line may detect the first sensing voltage Vsen1 formed in the sensing line RVL in the state of having turned off the switching transistor SWT and the sensing transistor SENT by applying a scan signal SCAN at a turn-off level.

In this process, to detect only the line capacitance Cline formed in the sensing line, both the switching transistor SWT and the sensing transistor SENT of the subpixel may be turned off. In this case, since the switching transistor SWT and the sensing transistor SENT may be connected with each other and be controlled by one scan signal SCAN, it is possible to simultaneously turn off the switching transistor SWT and sensing transistor SENT by applying one scan signal SCAN at the turn-off level.

Also, although the switching transistor SWT and sensing transistor SENT may be driven with the first scan signal SCAN1 and the second scan signal SCAN2, respectively, it is possible to simultaneously turn off the switching transistor SWT and sensing transistor SENT by applying the same signal as the first scan signal SCAN1 and the second scan signal SCAN2.

Further, the step S100 of detecting the first sensing voltage Vsen1 by the line capacitance Cline formed in the sensing line may detect the first sensing voltage Vsen1 by the line capacitance Cline if the sensing transistor SENT is turned off even though the switching transistor SWT is turned on.

Accordingly, when the switching transistor SWT and the sensing transistor SENT are driven by the first scan signal SCAN1 and the second scan signal SCAN2, respectively, the step S100 of detecting the first sensing voltage Vsen1 by the line capacitance Cline formed in the sensing line may also apply the first scan signal SCAN1 at a turn-on level to the switching transistor SWT while applying the second scan signal SCAN2 at a turn-off level to the sensing transistor SENT.

The first sensing voltage Vsen1 may be regarded as a unique characteristic value formed on the sensing line RVL.

The step S200 of detecting the second sensing voltage Vsen2 by the first light emitting element capacitance Ced1 and the line capacitance Cline may be a process for detecting the initial first light emitting element capacitance Ced1 formed by the light emitting element ED, together with the line capacitance Cline formed in the sensing line RVL.

Figure 10A:
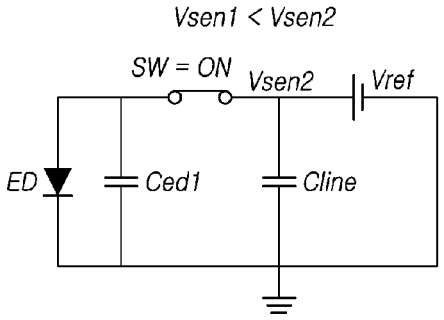
FIGS. 10A and 10B illustrate an example process for detecting a second sensing voltage by an initial first light emitting element capacitance formed by a light emitting element and a line capacitance formed in a sensing line in a display driving method according to example embodiments of the present disclosure.
Figure 10B:
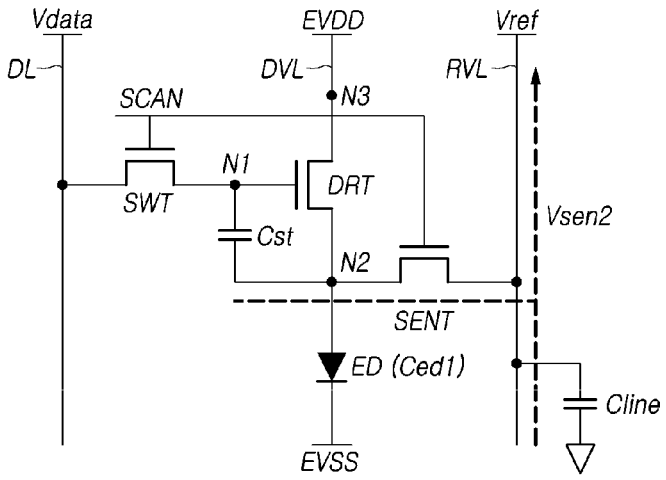

FIGS. 10A and 10B illustrate an example process for detecting a second sensing voltage by an initial first light emitting element capacitance formed by a light emitting element and a line capacitance formed in a sensing line in a display driving method according to example embodiments of the present disclosure.

As illustrated in FIGS. 10A and 10B, the display driving method according to example embodiments of the present disclosure may detect the second sensing voltage Vsen2 reflecting both the initial first light emitting element capacitance Ced1 formed by the light emitting element ED, along with the line capacitance Cline formed in the sensing line RVL, before degradation of the subpixel SP disposed on the display panel 110 occurs. In other words, the step S200 of detecting the second sensing voltage Vsen2 reflecting both the initial first light emitting element capacitance Ced1 formed by the light emitting element ED and the line capacitance Cline formed in the sensing line RVL may preferably be performed before the display device 100 is shipped out.

To this end, in a state in which the anode electrode of the light emitting element ED of the subpixel SP and the sensing line RVL are electrically connected, the reference voltage Vref may be applied to the sensing line RVL. After the sensing line RVL is discharged for a predetermined time, the sensing voltage Vsen2 may be measured so that the second sensing voltage Vsen2 reflecting both the initial first light emitting element capacitance Ced1 and the line capacitance Cline formed in the sensing line may be detected.

Conceptually (as shown in FIG. 10A), the switch SW positioned between the light emitting element ED and the sensing line may be turned on to electrically connect the light emitting element ED and the sensing line RVL. Thus, it may be possible to detect the second sensing voltage Vsen2 reflecting both the initial first light emitting element capacitance Ced1 and the line capacitance Cline formed in the sensing line RVL.

If this concept is applied to the subpixel circuit (as shown in FIG. 10B), the switch SW connecting the light emitting element ED and the sensing line RVL may correspond to the sensing transistor SENT.

Accordingly, the step S200 of detecting the second sensing voltage Vsen2 by the first light emitting element capacitance Ced1 and the line capacitance Cline may detect the second sensing voltage Vsen2 formed in the sensing line RVL in the state of having turned on the switching transistor SWT and the sensing transistor SENT by applying a scan signal SCAN at a turn-on level.

In this process, to detect both the initial first light emitting element capacitance Ced1 formed by the light emitting element ED and the line capacitance Cline formed in the sensing line RVL, the switching transistor SWT and sensing transistor SENT of the subpixel may both be turned on. In this case, since the switching transistor SWT and the sensing transistor SENT may be connected with each other and be controlled by one scan signal SCAN, it is possible to simultaneously turn on the switching transistor SWT and sensing transistor SENT by applying one scan signal SCAN at the turn-on level.

Also, although the switching transistor SWT and sensing transistor SENT may be driven with the first scan signal SCAN1 and the second scan signal SCAN2, respectively, it is possible to simultaneously turn on the switching transistor SWT and sensing transistor SENT by respectively applying the first scan signal SCAN1 and the second scan signal SCAN2 which are both at their turn-on level.

The second sensing voltage Vsen2 may be regarded as a characteristic value reflecting both the initial first light emitting element capacitance Ced1 formed by the light emitting element ED and the line capacitance Cline formed in the sensing line RVL, before the display device 100 is degraded. Accordingly, the second sensing voltage Vsen2 reflecting both the first light emitting element capacitance Ced1 and the line capacitance Cline may have a larger value than the first sensing voltage Vsen1 reflecting the line capacitance Cline alone.

Figure 11:
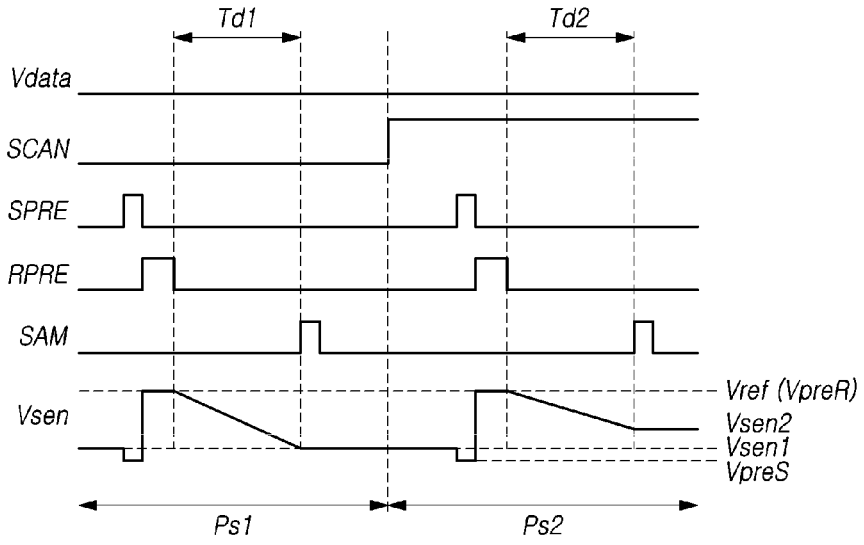
FIG. 11 illustrates an example signal waveform in a step of detecting a first sensing voltage and a step of detecting a second sensing voltage in a display driving method according to example embodiments of the present disclosure.

FIG. 11 illustrates an example signal waveform in a step of detecting a first sensing voltage and a step of detecting a second sensing voltage in a display driving method according to example embodiments of the present disclosure.

Described here is an example in which the switching transistor SWT and sensing transistor SENT are driven by one scan signal SCAN.

As shown in FIG. 11, in the display driving method according to example embodiments of the present disclosure, the step S100 of detecting the first sensing voltage Vsen1 and the step S200 of detecting the second sensing voltage Vsen2 may be successively performed.

The step S100 of detecting the first sensing voltage Vsen1 and the step S200 of detecting the second sensing voltage Vsen2 may be performed before degradation of the subpixel SP disposed on the display panel 110 occurs or before the display device 100 is shipped out.

The step S100 of detecting the first sensing voltage Vsen1 may be performed during a first sensing period Ps1. During this period, the sensing transistor SENT connecting the light emitting element ED of the subpixel SP to the sensing line RVL may remain in the turned-off state.

In this state, the reference voltage Vref may be applied to charge the sensing line RVL with the reference voltage Vref. In this case, the reference voltage Vref for charging the sensing line RVL may be the display reference voltage VpreR supplied through the display reference switch RPRE. Further, before charging the sensing line RVL with the display reference voltage VpreR, the display sensing switch SPRE may be turned on to apply the display sensing voltage VpreS corresponding to the ground level to the sensing line RVL, thereby initializing the sensing line RVL.

In the illustrated example, after the sensing line RVL is initialized to the display sensing voltage VpreS, the display reference voltage VpreR is applied as the reference voltage Vref. However, the display sensing voltage VpreS may be applied as the reference voltage Vref or, without the initialization process, the display reference voltage VpreR may be applied as the reference voltage Vref.

After charging the sensing line RVL with the reference voltage Vref, the sensing line RVL may be discharged during a first discharge period Td1. The line capacitance Cline formed in the sensing line RVL may be detected by measuring the first sensing voltage Vsen1 remaining in the sensing line RVL after the first discharge period Td1 has elapsed.

The step S200 of detecting the second sensing voltage Vsen2 may be performed during a second sensing period Ps2 after the first sensing period Psi has elapsed. During the second sensing period Ps2, the sensing transistor SENT connecting the light emitting element ED constituting the subpixel SP and the sensing line RVL may remain in the turned-on state.

In this state, the reference voltage Vref may be applied to charge the sensing line RVL with the reference voltage Vref. In this case, the reference voltage Vref for charging the sensing line RVL may be the display reference voltage VpreR supplied through the display reference switch RPRE. Further, before charging the sensing line RVL with the display reference voltage VpreR, the display sensing switch SPRE may be turned on to apply the display sensing voltage VpreS corresponding to the ground level to the sensing line RVL, thereby initializing the sensing line RVL.

Likewise, in this process, after the sensing line RVL is initialized to the display sensing voltage VpreS, the display reference voltage VpreR may be applied as the reference voltage Vref. However, it is also possible that the display sensing voltage VpreS may be applied as the reference voltage Vref or, without the initialization process, the display reference voltage VpreR may be applied as the reference voltage Vref.

After charging the sensing line RVL with the reference voltage Vref, the sensing line RVL may be discharged during a second discharge period Td2. It is possible to detect the second sensing voltage Vsen2 reflecting both the initial first light emitting element capacitance Ced1 formed by the light emitting element ED and the line capacitance Cline formed in the sensing line RVL by measuring the second sensing voltage Vsen2 remaining in the sensing line RVL after the second discharge period Td2 has elapsed.

The difference between the second sensing voltage Vsen2 and the first sensing voltage Vsen1 may indicate a value corresponding to the initial first light emitting element capacitance Ced1 formed by the light emitting element ED before the display device 100 is degraded.

It may be preferable that the first discharge period Td1 in the first sensing period Psi and the second discharge period Td2 in the second sensing period Ps2 have the same time duration.

The step S300 of detecting the third sensing voltage Vsen3 reflecting degradation of the subpixel SP may be a process for detecting the second light emitting element capacitance Ced2 reflecting degradation of the light emitting element ED, along with the line capacitance Cline formed in the sensing line RVL, after the display device 100 is shipped out.

The step S300 of detecting the third sensing voltage Vsen3 may be performed during an on-sensing process, an off-sensing process, or a real-time sensing process.

Figure 12A:
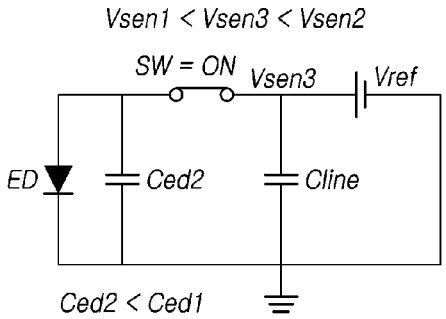
FIGS. 12A and 12B illustrate an example process for detecting a third sensing voltage by a second light emitting element capacitance reflecting degradation of a light emitting element and a line capacitance formed in a sensing line in a display driving method according to example embodiments of the present disclosure.
Figure 12B:
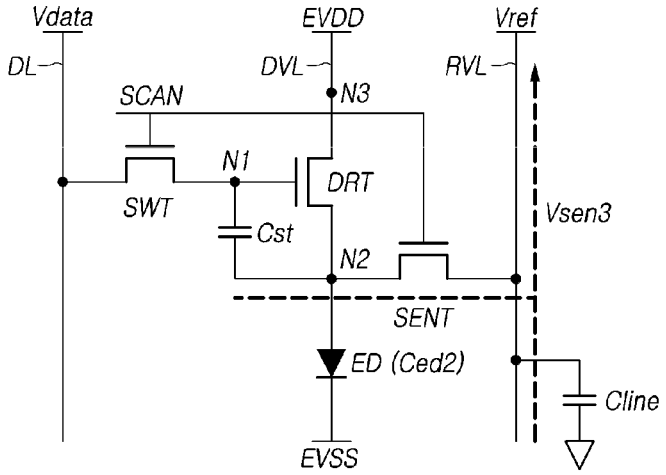

FIGS. 12A and 12B illustrate an example process for detecting a third sensing voltage by a second light emitting element capacitance reflecting degradation of a light emitting element and a line capacitance formed in a sensing line in a display driving method according to example embodiments of the present disclosure.

As illustrated in FIGS. 12A and 12B, the display driving method according to example embodiments of the present disclosure may detect the third sensing voltage Vsen3 reflecting both the second light emitting element capacitance Ced2 reflecting degradation of the subpixel SP and the line capacitance Cline formed in the sensing line RVL after the display device 100 is shipped out and display driving is then performed for a predetermined amount of time. In other words, the step S300 of detecting the third sensing voltage Vsen3 reflecting both the second light emitting element capacitance Ced2 reflecting degradation of the subpixel SP and the line capacitance Cline formed in the sensing line RVL may preferably be performed after the display device 100 is shipped out.

In this case, since the second light emitting element capacitance Ced2 may reflect degradation of the light emitting element ED by the driving of the display device 100, the second light emitting element capacitance Ced2 may have a smaller value than the first light emitting element capacitance Ced1 corresponding to the state of the light emitting element ED before degradation.

To this end, in a state in which the anode electrode of the light emitting element ED of the subpixel SP and the sensing line RVL are electrically connected, the reference voltage Vref may be applied to the sensing line RVL. After the sensing line RVL is discharged for a predetermined time, the third sensing voltage Vsen3 is measured so that the third sensing voltage Vsen3 reflecting both the second light emitting element capacitance Ced2 and the line capacitance Cline formed in the sensing line may be detected.

Accordingly, the third sensing voltage Vsen3 reflecting the degradation of the light emitting element ED may have a smaller value than the second sensing voltage Vsen2 measured before the light emitting element ED is degraded.

Conceptually (as shown in FIG. 12A), the switch SW positioned between the light emitting element ED and the sensing line may be turned on to electrically connect the light emitting element ED and the sensing line RVL. Thus, it is possible to detect the third sensing voltage Vsen3 reflecting both the second light emitting element capacitance Ced2 and the line capacitance Cline formed in the sensing line RVL.

If this concept is applied to the subpixel circuit (as shown in FIG. 12A), the switch SW connecting the light emitting element ED and the sensing line RVL may correspond to the sensing transistor SENT.

Accordingly, the step S300 of detecting the third sensing voltage Vsen3 by the second light emitting element capacitance Ced2 and the line capacitance Cline may detect the third sensing voltage Vsen3 formed in the sensing line RVL in the state of having turned on the switching transistor SWT and the sensing transistor SENT by applying a scan signal SCAN at a turn-on level.

In this process, to detect both the second light emitting element capacitance Ced2 reflecting the degradation of the light emitting element ED and the line capacitance Cline formed in the sensing line RVL, the switching transistor SWT and sensing transistor SENT of the subpixel may both be turned on. In this case, since the switching transistor SWT and the sensing transistor SENT may be connected with each other and be controlled by one scan signal SCAN, it is possible to simultaneously turn on the switching transistor SWT and sensing transistor SENT by applying one scan signal SCAN at the turn-on level.

Also, even if the switching transistor SWT and sensing transistor SENT are driven with the first scan signal SCAN1 and the second scan signal SCAN2, respectively, it is possible to simultaneously turn on the switching transistor SWT and sensing transistor SENT by applying the first scan signal SCAN1 and the second scan signal SCAN2 which are both at their turn-on level.

The third sensing voltage Vsen3 may be regarded as a characteristic value reflecting the second light emitting element capacitance Ced2 reflecting the degradation of the light emitting element ED and the line capacitance Cline formed in the sensing line RVL after the display device 100 is driven for a predetermined time.

Figure 13:
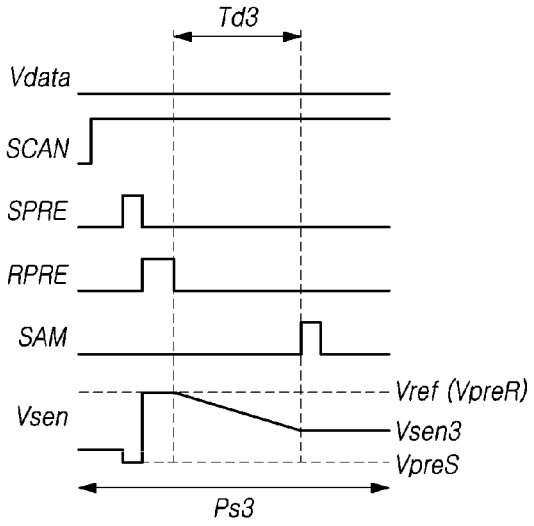
FIG. 13 illustrates an example signal waveform in a step of detecting a third sensing voltage in a display driving method according to example embodiments of the present disclosure.

FIG. 13 illustrates an example signal waveform in a step of detecting a third sensing voltage in a display driving method according to example embodiments of the present disclosure.

As shown in FIG. 13, in the display driving method according to example embodiments of the present disclosure, the step S300 of detecting the third sensing voltage Vsen3 may be performed in a third sensing period Ps3, after the display device 100 is shipped out and is then driven for a predetermined amount of time. During the third sensing period Ps3, the sensing transistor SENT connecting the light emitting element ED of the subpixel SP and the sensing line RVL may remain in the turned-on state.

In this state, the reference voltage Vref may be applied to charge the sensing line RVL with the reference voltage Vref. In this case, the reference voltage Vref for charging the sensing line RVL may be the display reference voltage VpreR supplied through the display reference switch RPRE. Further, before charging the sensing line RVL with the display reference voltage VpreR, the display sensing switch SPRE may be turned on to apply the display sensing voltage VpreS corresponding to the ground level to the sensing line RVL, thereby initializing the sensing line RVL.

In this case, after the sensing line RVL is initialized to the display sensing voltage VpreS, the display reference voltage VpreR may be applied as the reference voltage Vref. However, it is also possible that the display sensing voltage VpreS may be applied as the reference voltage Vref or, without the initialization process, the display reference voltage VpreR may be applied as the reference voltage Vref.

After charging the sensing line RVL with the reference voltage Vref, the sensing line RVL may be discharged during a third discharge period Td3. It is possible to detect the third sensing voltage Vsen3 reflecting both the second light emitting element capacitance Ced2 reflecting the degradation of the light emitting element ED and the line capacitance Cline formed in the sensing line RVL by measuring the third sensing voltage Vsen3 remaining in the sensing line RVL after the third discharge period Td3 has elapsed.

The difference between the third sensing voltage Vsen3 and the first sensing voltage Vsen1 may indicate a value corresponding to the second light emitting element capacitance Ced2 reflecting the degradation of the light emitting element ED due to the driving of the display device 100.

It may be preferable that the second discharge period Td2 in the second sensing period Ps2 and the third discharge period Td3 in the third sensing period Ps3 have the same time duration.

The step S400 of detecting the deviation in the characteristic value of the subpixel SP may be a process for determining the difference between the first light emitting element capacitance Ced1 corresponding to the state of the light emitting element ED before degradation and the second light emitting element capacitance Ced2 reflecting the degraded state of the light emitting element ED, using the first sensing voltage Vsen1, the second sensing voltage Vsen2, and the third sensing voltage Vsen3.

In other words, the difference between the first light emitting element capacitance Ced1 corresponding to the state of the light emitting element ED before degradation and the second light emitting element capacitance Ced2 reflecting the degraded state indicates the degree of degradation of the light emitting element ED.

The step 5500 of supplying the compensation data DATA_comp according to the deviation in the characteristic value of the subpixel SP may be a process for supplying the compensated image data to the corresponding subpixel SP by reflecting the degree of degradation of the light emitting element ED.

In this case, the timing controller 140 may store the line capacitance Cline corresponding to the first sensing voltage Vsen1 and the first light emitting element capacitance Ced1 calculated by the second sensing voltage Vsen2 in the memory MEM in the form of a lookup table. Further, the timing controller 140 may include a compensation circuit COMP for calculating the deviation in the characteristic value of the subpixel SP reflecting the degree of degradation of the light emitting element ED, using the second light emitting element capacitance Ced2 calculated by the third sensing voltage Vsen3 reflecting the degradation of the light emitting element ED, and for compensating for the deviation.

FIG. 14 illustrates an example of data stored in a memory to calculate a deviation in characteristic value between subpixels in a display device according to example embodiments of the present disclosure.

As illustrated in FIG. 14, the display device 100 according to embodiments of the present disclosure may store, in the memory MEM, the first sensing voltage Vsen1 and the line capacitance Cline corresponding to the first sensing voltage Vsen1, the second sensing voltage Vsen2 and the first light emitting element capacitance Ced1 calculated by the second sensing voltage Vsen2, and the third sensing voltage Vsen3 reflecting the degradation of the light emitting element ED and the second light emitting element capacitance Ced2 calculated by the third sensing voltage Vsen3. The example display device 100 may calculate the deviation in the characteristic value of the subpixel SP reflecting the degree of degradation of the light emitting element ED, using these stored values.

For example, the first sensing voltage Vsen1 detected in the first sensing period Ps1 may indicate a value corresponding to the line capacitance Cline formed in the sensing line RVL.

The second sensing voltage Vsen2 detected in the second sensing period Ps2 may indicate a value reflecting both the initial first light emitting element capacitance Ced1 formed by the light emitting element ED before degradation and the line capacitance Cline formed in the sensing line RVL.

Accordingly, the difference between the second sensing voltage Vsen2 and the first sensing voltage Vsen1 may indicate a value corresponding to the initial first light emitting element capacitance Ced1 formed by the light emitting element ED before the display device 100 is degraded.

The third sensing voltage Vsen3 detected in the third sensing period Ps3 may indicate a value reflecting both the second light emitting element capacitance Ced2 reflecting the degradation of the light emitting element ED and the line capacitance Cline formed in the sensing line RVL.

Accordingly, the difference between the third sensing voltage Vsen3 and the second sensing voltage Vsen2 may indicate a value corresponding to the second light emitting element capacitance Ced2 reflecting the degradation of the light emitting element ED due to the driving of the display device 100.

As a result, the difference between the third sensing voltage Vsen3 and the second sensing voltage Vsen2 may indicate a value corresponding to the difference between the initial first light emitting element capacitance Ced1 formed by the light emitting element ED before the display device 100 is degraded and the second light emitting element capacitance Ced2 reflecting the degraded state of the light emitting element ED due to the driving of the display device 100.

Thus, it is possible to determine the degree of degradation of the light emitting element ED, i.e., the deviation in the characteristic value of the subpixel SP, based on the difference between the third sensing voltage Vsen3 and the second sensing voltage Vsen2 and to compensate for the deviation in characteristic value by supplying the compensation data DATA_comp reflecting the deviation in a characteristic value of the corresponding subpixel SP.

A display device and a display driving method according to various example embodiments of the present disclosure are described below.

A display device according example embodiments may comprise: a display panel having a plurality of subpixels for displaying an image, a first subpixel among the plurality of subpixels including a light emitting element and being connected to a sensing line in the display panel for sensing a characteristic value of the first subpixel; a gate driving circuit configured to supply a plurality of scan signals to the display panel, including a scan signal to the first subpixel through a gate line among a plurality of gate lines in the display panel; a data driving circuit configured to supply a plurality of data voltages to the display panel, including a data voltage to the first subpixel through a data line among a plurality of data lines in the display panel; and a timing controller. The timing controller may be configured to: control the gate driving circuit to supply the scan signal to the first subpixel; determine compensation data for compensating for a deviation in the characteristic value of the first subpixel, based on a first sensing voltage corresponding to a line capacitance of the sensing line, a second sensing voltage corresponding to both a first light emitting element capacitance of the light emitting element and the line capacitance of the sensing line, and a third sensing voltage corresponding to both a second light emitting element capacitance of the light emitting element and the line capacitance of the sensing line; and control the data driving circuit based on the compensation data to supply the data voltage to the first subpixel.

In some example embodiments, the sensing line may be a reference voltage line configured to receive a reference voltage.

In some example embodiments, the characteristic value of the first subpixel may correspond to a capacitance formed between an anode electrode and a cathode electrode of the light emitting element.

In some example embodiments, the first subpixel may further include: a driving transistor configure to provide a current to the light emitting element; a switching transistor electrically connected between a gate node of the driving transistor and the data line; a sensing transistor electrically connected between one of a source node and a drain node of the driving transistor and the sensing line; and a storage capacitor electrically connected between a gate node and the one of the source node and the drain node of the driving transistor.

In some example embodiments, the gate node of the switching transistor and a gate node of the sensing transistor may be configured to be simultaneously controlled by the scan signal.

In some example embodiments, the data driving circuit may include: an analog-to-digital converter configured to convert a voltage detected at the sensing line into a digital value; a sampling switch configured to control a connection between the sensing line and the analog-to-digital converter;

a display reference switch configured to control supplying of a display reference voltage to the sensing line; and a sensing reference switch configured to control supplying of a sensing reference voltage to the sensing line.

In some example embodiments, the first sensing voltage is a voltage detected through the sensing line, after a first discharge period after the display reference voltage is applied to the sensing line with both the switching transistor and the sensing transistor in a turned-off state in a first sensing period.

In some example embodiments, the second sensing voltage is a voltage detected through the sensing line, after a second discharge period after the display reference voltage is applied to the sensing line with both the switching transistor and the sensing transistor in a turned-on state in a second sensing period after the first sensing period.

In some example embodiments, the third sensing voltage is a voltage detected through the sensing line, after a third discharge period after the display reference voltage is applied to the sensing line with both the switching transistor and the sensing transistor in the turned-on state in a third sensing period after the second sensing period.

In some example embodiments, the first discharge period, the second discharge period, and the third discharge period may have the same time duration.

In some example embodiments, the display device may further comprise a memory storing the first sensing voltage and the second sensing voltage, a difference between the second sensing voltage and the first sensing voltage corresponding to an initial characteristic value of the first subpixel. The timing controller may be further configured to determine the compensation data based on a difference between the third sensing voltage and the second sensing voltage, the difference between the third sensing voltage and the second sensing voltage representing the deviation in the characteristic value of the first subpixel.

In some example embodiments of the present disclosure, for a display device including a display panel having a plurality of subpixels for displaying an image, a first subpixel among the plurality of subpixels including a light emitting element and being connected to a sensing line in the display panel for sensing a characteristic value of the first subpixel, a method of driving the display device may comprise: detecting a first sensing voltage on the sensing line corresponding to a line capacitance formed in a sensing line; detecting a second sensing voltage on the sensing line corresponding to a first light emitting element capacitance of the light emitting element and the line capacitance of the sensing line; detecting a third sensing voltage on the sensing line reflecting a deviation in the characteristic value of the first subpixel; determining the deviation in the characteristic value of the first subpixel based on the first sensing voltage, the second sensing voltage, and the third sensing voltage; determining compensation data according to the deviation in the characteristic value of the first subpixel; and driving the first subpixel based on the compensation data.

In some example embodiments, the characteristic value of the first subpixel may correspond to a capacitance formed between an anode electrode and a cathode electrode of the light emitting element.

In some example embodiments, the first subpixel may further be connected to a gate line and a data line and may further include: a driving transistor configured to provide a current to the light emitting element; a switching transistor electrically connected between a gate node of the driving transistor and the data line; a sensing transistor electrically connected between one of the source node and the drain node of the driving transistor and the sensing line; and a storage capacitor electrically connected between a gate node and the one of the source node and the drain node of the driving transistor, wherein the gate node of the switching transistor and a gate node of the sensing transistor are configured to be simultaneously controlled by one scan signal.

In some example embodiments, the detecting of the first sensing voltage may include: applying a display reference voltage to the sensing line with both the switching transistor and the sensing transistor in a turned-off state in a first sensing period; and detecting the first sensing voltage through the sensing line, after a first discharge period after the display reference voltage is applied to the sensing line in the first sensing period.

In some example embodiments, the detecting of the second sensing voltage may include: applying the display reference voltage to the sensing line with both the switching transistor and the sensing transistor in a turned-on state in a second sensing period after the first sensing period; and detecting the second sensing voltage through the sensing line, after a second discharge period after the display reference voltage is applied to the sensing line in the second sensing period.

In some example embodiments, the detecting of the third sensing voltage may include: applying the display reference voltage to the sensing line with both the switching transistor and the sensing transistor in the turned-on state in a third sensing period after the second sensing period; and detecting the third sensing voltage through the sensing line, after a third discharge period after the display reference voltage is applied to the sensing line in the third sensing period.

In some example embodiments, the first discharge period, the second discharge period, and the third discharge period may have the same time duration.

In some example embodiments, the method may further comprise applying an initialization voltage before the display reference voltage is applied in at least one of the first sensing period, the second sensing period, and the third sensing period.

In some example embodiments, a difference between the second sensing voltage and the first sensing voltage may correspond to an initial characteristic value of the first subpixel. The determining of the compensation data may include: determining a difference between the third sensing voltage and the second sensing voltage, the difference between the third sensing voltage and the second sensing voltage representing the deviation in the characteristic value of the first subpixel; and determining the compensation data based on the difference between the third sensing voltage and the second sensing voltage.

The above description has been presented to enable any person skilled in the art to make and use the various possible embodiments of the present disclosure. Although the example embodiments of the present disclosure have been described in more detail with reference to the accompanying drawings, the present disclosure is not limited thereto and may be embodied in many different forms without departing from the technical concept of the present disclosure. Therefore, the example embodiments disclosed in the present disclosure are provided for illustrative purposes only and are not intended to limit the technical concept of the present disclosure. Therefore, it should be understood that the above-described example embodiments are illustrative in all aspects and do not limit the present disclosure.

It will be apparent to those skilled in the art that various modifications and variations can be made in the present disclosure without departing from the spirit or scope of the disclosures. Thus, it is intended that the present disclosure cover such modifications and variations of this disclosure, provided that they come within the scope of the appended claims and their equivalents.

What is claimed is:

1. A display device, comprising:

a display panel having a plurality of subpixels for displaying an image, a first subpixel among the plurality of subpixels including a light emitting element and being connected to a sensing line in the display panel for sensing a characteristic value of the first subpixel;

a gate driving circuit configured to supply a plurality of scan signals to the display panel, including a scan signal to the first subpixel through a gate line among a plurality of gate lines in the display panel;

a data driving circuit configured to supply a plurality of data voltages to the display panel, including a data voltage to the first subpixel through a data line among a plurality of data lines in the display panel; and a timing controller configured to:

control the gate driving circuit to supply the scan signal to the first subpixel;

determine compensation data for compensating for a deviation in the characteristic value of the first subpixel, based on a first sensing voltage corresponding to a line capacitance of the sensing line, a second sensing voltage corresponding to both a first light emitting element capacitance of the light emitting element and the line capacitance of the sensing line, and a third sensing voltage corresponding to both a second light emitting element capacitance of the light emitting element and the line capacitance of the sensing line; and control the data driving circuit based on the compensation data to supply the data voltage to the first subpixel, wherein the first subpixel further includes:

a driving transistor configured to provide a current to the light emitting element;

a switching transistor electrically connected between a gate node of the driving transistor and the data line;

a sensing transistor electrically connected between one of a source node and a drain node of the driving transistor and the sensing line; and a storage capacitor electrically connected between a gate node and the one of the source node and the drain node of the driving transistor, and wherein the first sensing voltage is a voltage detected through the sensing line, after a first discharge period after a display reference voltage is applied to the sensing line with both the switching transistor and the sensing transistor in a turned-off state in a first sensing period.

2. The display device of claim 1, wherein the sensing line is a reference voltage line configured to receive a reference voltage.

3. The display device of claim 1, wherein the characteristic value of the first subpixel corresponds to a capacitance formed between an anode electrode and a cathode electrode of the light emitting element.

4. The display device of claim 1, wherein the gate node of the switching transistor and a gate node of the sensing transistor are configured to be simultaneously controlled by the scan signal.

5. The display device of claim 1, wherein the data driving circuit includes:

an analog-to-digital converter configured to convert a voltage detected at the sensing line into a digital value;

a sampling switch configured to control a connection between the sensing line and the analog-to-digital converter;

a display reference switch configured to control supplying of the display reference voltage to the sensing line; and a sensing reference switch configured to control supplying of a sensing reference voltage to the sensing line.

6. The display device of claim 1, wherein the second sensing voltage is a voltage detected through the sensing line, after a second discharge period after the display reference voltage is applied to the sensing line with both the switching transistor and the sensing transistor in a turned-on state in a second sensing period after the first sensing period.

7. The display device of claim 6, wherein the third sensing voltage is a voltage detected through the sensing line, after a third discharge period after the display reference voltage is applied to the sensing line with both the switching transistor and the sensing transistor in the turned-on state in a third sensing period after the second sensing period.

8. The display device of claim 7, wherein the first discharge period, the second discharge period, and the third discharge period have the same time duration.

9. The display device of claim 1, further comprising:

a memory storing the first sensing voltage and the second sensing voltage, a difference between the second sensing voltage and the first sensing voltage corresponding to an initial characteristic value of the first subpixel, wherein the timing controller is further configured to determine the compensation data based on a difference between the third sensing voltage and the second sensing voltage, the difference between the third sensing voltage and the second sensing voltage representing the deviation in the characteristic value of the first subpixel.

10. A method for driving a display device including a display panel having a plurality of subpixels for displaying an image, a first subpixel among the plurality of subpixels including a light emitting element and being connected to a sensing line in the display panel for sensing a characteristic value of the first subpixel, the method comprising:

detecting a first sensing voltage on the sensing line corresponding to a line capacitance formed in the sensing line;

detecting a second sensing voltage on the sensing line corresponding to a first light emitting element capacitance of the light emitting element and the line capacitance of the sensing line;

detecting a third sensing voltage on the sensing line reflecting a deviation in the characteristic value of the first subpixel;

determining the deviation in the characteristic value of the first subpixel based on the first sensing voltage, the second sensing voltage, and the third sensing voltage;

determining compensation data according to the deviation in the characteristic value of the first subpixel; and driving the first subpixel based on the compensation data, wherein the first subpixel is further connected to a gate line and a data line and further includes:

a driving transistor configured to provide a current to the light emitting element;

a switching transistor electrically connected between a gate node of the driving transistor and the data line;

a sensing transistor electrically connected between one of the source node and the drain node of the driving transistor and the sensing line; and a storage capacitor electrically connected between a gate node and the one of the source node and the drain node of the driving transistor, wherein the gate node of the switching transistor and a gate node of the sensing transistor are configured to be simultaneously controlled by one scan signal, and wherein the detecting of the first sensing voltage includes:

applying a display reference voltage to the sensing line with both the switching transistor and the sensing transistor in a turned-off state in a first sensing period; and detecting the first sensing voltage through the sensing line, after a first discharge period after the display reference voltage is applied to the sensing line in the first sensing period.

11. The method of claim 10, wherein the characteristic value of the first subpixel corresponds to a capacitance formed between an anode electrode and a cathode electrode of the light emitting element.

12. The method of claim 10, wherein the detecting of the second sensing voltage includes:

applying the display reference voltage to the sensing line with both the switching transistor and the sensing transistor in a turned-on state in a second sensing period after the first sensing period; and detecting the second sensing voltage through the sensing line, after a second discharge period after the display reference voltage is applied to the sensing line in the second sensing period.

13. The method of claim 12, wherein the detecting of the third sensing voltage includes:

applying the display reference voltage to the sensing line with both the switching transistor and the sensing transistor in the turned-on state in a third sensing period after the second sensing period; and detecting the third sensing voltage through the sensing line, after a third discharge period after the display reference voltage is applied to the sensing line in the third sensing period.

14. The method of claim 13, wherein the first discharge period, the second discharge period, and the third discharge period have the same time duration.

15. The method of claim 13, further comprising applying an initialization voltage before the display reference voltage is applied in at least one of the first sensing period, the second sensing period, and the third sensing period.

16. The method of claim 10, wherein a difference between the second sensing voltage and the first sensing voltage corresponds to an initial characteristic value of the first subpixel, and wherein the determining of the compensation data includes:

determining a difference between the third sensing voltage and the second sensing voltage, the difference between the third sensing voltage and the second sensing voltage representing the deviation in the characteristic value of the first subpixel; and determining the compensation data based on the difference between the third sensing voltage and the second sensing voltage.

* * * * *